US008146679B2

(12) United States Patent
Downton

(10) Patent No.: US 8,146,679 B2
(45) Date of Patent: Apr. 3, 2012

(54) VALVE-CONTROLLED DOWNHOLE MOTOR

(75) Inventor: Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 353 days.

(21) Appl. No.: 12/323,754

(22) Filed: Nov. 26, 2008

(65) Prior Publication Data

US 2010/0126774 A1 May 27, 2010

(51) Int. Cl.
*E21B 4/02* (2006.01)
*E21B 4/20* (2006.01)

(52) U.S. Cl. ..... 175/26; 175/61; 175/92; 175/107

(58) Field of Classification Search ..... 175/26, 175/107, 106, 61, 73, 92
See application file for complete search history.

(56) References Cited

U.S. PATENT DOCUMENTS

| | | | | |
|---|---|---|---|---|
| 1,731,553 | A | | 10/1929 | Van Keulen |
| 3,198,088 | A | * | 8/1965 | Johnson et al. ..... 91/420 |
| 4,033,236 | A | * | 7/1977 | Johnson et al. ..... 91/463 |
| 5,113,953 | A | | 5/1992 | Noble et al. |
| 5,265,682 | A | | 11/1993 | Russell et al. |
| 5,520,255 | A | | 5/1996 | Barr et al. |
| 5,553,678 | A | | 9/1996 | Barr et al. |
| 5,553,679 | A | | 9/1996 | Thorp et al. |
| 5,582,259 | A | | 12/1996 | Barr et al. |
| 5,603,385 | A | | 2/1997 | Colebrook et al. |
| 5,673,763 | A | | 10/1997 | Thorp et al. |
| 5,685,379 | A | | 11/1997 | Barr et al. |
| 5,695,015 | A | | 12/1997 | Barr et al. |
| 5,706,905 | A | | 1/1998 | Barr et al. |
| 5,778,992 | A | | 7/1998 | Fuller et al. |
| 5,803,185 | A | | 9/1998 | Barr et al. |
| 5,971,085 | A | | 10/1999 | Colebrook et al. |
| 6,089,332 | A | | 7/2000 | Barr et al. |
| 6,092,610 | A | | 7/2000 | Kosmala et al. |
| 6,158,529 | A | | 12/2000 | Dorel |
| 6,244,361 | B1 | | 6/2001 | Comeau et al. |

(Continued)

FOREIGN PATENT DOCUMENTS

| | | |
|---|---|---|
| WO | 99/64715 | 12/1999 |
| WO | 02/079604 | 10/2002 |

(Continued)

OTHER PUBLICATIONS

Samuel, G. Robello, "Downhole Drilling Tools: Theory & Practice for Engineers & Students" 288-333 (2007).

(Continued)

*Primary Examiner* — Brad Harcourt
(74) *Attorney, Agent, or Firm* — Jeremy P. Welch

(57) ABSTRACT

The present invention relates to systems and methods for controlling downhole motors. One aspect of the invention provides a valve-controlled downhole motor including: a downhole motor and a spool valve. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

26 Claims, 6 Drawing Sheets

U.S. PATENT DOCUMENTS

| | | | | |
|---|---|---|---|---|
| 6,289,998 | B1 | 9/2001 | Krueger et al. | |
| 6,364,034 | B1 | 4/2002 | Schoeffler | |
| 6,394,193 | B1 | 5/2002 | Askew | |
| 2001/0052428 | A1 | 12/2001 | Larronde et al. | |
| 2002/0011359 | A1 | 1/2002 | Webb et al. | |
| 2006/0243493 | A1 | 11/2006 | El-Rayes | |
| 2007/0151767 | A1* | 7/2007 | Downton | 175/73 |
| 2008/0164062 | A1 | 7/2008 | Brackin et al. | |

OTHER PUBLICATIONS

"Standard Handbook of Petroleum & Natural Gas Engineering" 4-276-4-299 (William C. Lyons & Gary J. Plisga eds. 2006).

Gelfgat, Yakov A et al. "Advanced Drilling Solutions: Lessons from the FSU" 154-72 (2003).

Dickenson, T. Christopher, "Valves, Piping & Pipelines Handbook" 138-45 (3rd ed. 1999).

* cited by examiner

VALVE-CONTROLLED DOWNHOLE MOTOR

FIELD OF THE INVENTION

The present invention relates to systems and methods for controlling downhole motors and drilling systems incorporating such systems and methods.

BACKGROUND OF THE INVENTION

Mud motors are powerful generators used in drilling operations to turn a drill bit, generate electricity, and the like. The speed and torque produced by a mud motor is affected by the design of the mud motor and the flow of mud (drilling fluid) into the mud motor. Control over these parameters is attempted from the surface of a wellbore by adjusting the flow rate and pressure of mud, adjusting the weight on the drill bit (WOB). The fidelity of control by these techniques is poor, however. Motors can stall and suffer speed variations as a consequence of loading and drill string motion. Accordingly, there is a need for devices and methods for more responsively and precisely controlling the operation of a mud motor.

SUMMARY OF THE INVENTION

The present invention relates to systems and methods for controlling downhole motors.

One aspect of the invention provides a valve-controlled downhole motor including: a downhole motor and a spool valve. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

This aspect can have several embodiments. The spool valve can be configured for actuation to a locking position that substantially halts movement of the downhole motor. The first gland can substantially inhibit flow from the inlet port, and the second gland can substantially inhibit flow to the exhaust port. The first gland can completely inhibit flow from the inlet port, and the second gland can completely inhibit flow to the exhaust port. The first gland and the second gland can allow a substantially equal flow of fluid from the inlet port to the first feed port the second feed port and from the first return port and the second return port to the exhaust port.

The spool valve can be configured for actuation to a forward position that propels the rotor of the downhole motor in a first direction. The first gland can allow unimpeded flow from the inlet port to the first feed port, and the second gland can allow unimpeded flow from the first return port to the exhaust port. The first gland can allow partially impeded flow from the inlet port to the first feed port, and the second gland can allow partially impeded flow from the first return port to the exhaust port.

The spool valve can be configured for actuation to a reverse position that propels the rotor of the downhole motor in a second direction. The second direction can be opposite from the first direction. The first gland can allow unimpeded flow from the inlet port to the second feed port, and the second gland can allow unimpeded flow from the second return port to the exhaust port. The first gland can allow partially impeded flow from the inlet port to the second feed port, and the second gland can allow partially impeded flow from the second return port to the exhaust port.

The spool valve can be mechanically actuated. The spool valve can be electrically actuated. The spool valve can be pneumatically actuated. The downhole motor can be a turbine motor. The downhole motor can be a positive displacement motor. The downhole motor can be Moineau-type positive displacement motor. The spool valve can be configured such that there is a linear relationship between a position of the spool and a rotational velocity of the rotor. The valve-controlled downhole motor can be received within a drill string collar. The valve-controlled downhole motor can include a collar speed sensor for measuring the rotational speed of the drill string collar.

The valve-controlled downhole motor can be configured to point a bit coupled with the drill string collar. The valve-controlled downhole motor can be configured for side tracking.

The valve-controlled downhole motor can include a shaft connected to the rotor. The shaft can be an offset shaft. The valve-controlled downhole motor can include a shaft speed sensor for measuring the rotational speed of the shaft. The valve-controlled downhole motor can include a processor configured to calculate the relative speed of the shaft with respect to the collar. The spool valve can be a bi-stable actuator.

Another aspect of the invention provides a bottom hole assembly including a drill string collar and an actuatable arm coupled with the drill string collar.

This aspect can have a variety of embodiments. The actuatable arm can lie within and substantially parallel to a central axis of the drill string collar when the drill string collar is rotated. The actuatable arm can be actuated to an angled position by a first valve-controlled downhole motor.

The first valve-controlled downhole motor can include a downhole motor and a spool valve. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

The spool valve can be actuated by a servo. The actuatable arm can also include a second valve-controlled downhole motor, a shaft coupled to the second valve-controlled downhole motor, and a bit coupled to the shaft.

The second valve-controlled downhole motor can include a downhole motor and a spool valve. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

Another aspect of the invention provides a drilling method. The method includes providing a drill string having a valve-controlled downhole motor including a downhole motor and a spool valve, a shaft coupled to the valve-controlled downhole motor, and a bit coupled to the shaft; and actuating the spool valve to a variety of positions to control the rotational speed and direction of the shaft and the bit. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

Another aspect of the invention provides a drill string including a downhole motor, a spool valve, a shaft coupled to the downhole motor, and a bit coupled to the shaft. The downhole motor includes a sealed chamber having a first port and a second port, a stator received within the sealed chamber, and a rotor received within the stator. The spool valve includes a barrel and a spool received within the barrel. The barrel includes an inlet port, an exhaust port, a first feed port, a second feed port, a first return port, and a second return port. The inlet port is located in proximity to the first feed port and second port. The exhaust port is located in proximity to the first return port and the second return port. The spool includes a first gland and a second gland.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The present invention relates to systems and methods for controlling downhole motors. Various embodiments of the invention can be used in a wellsite system.

Wellsite System

Figure 1:
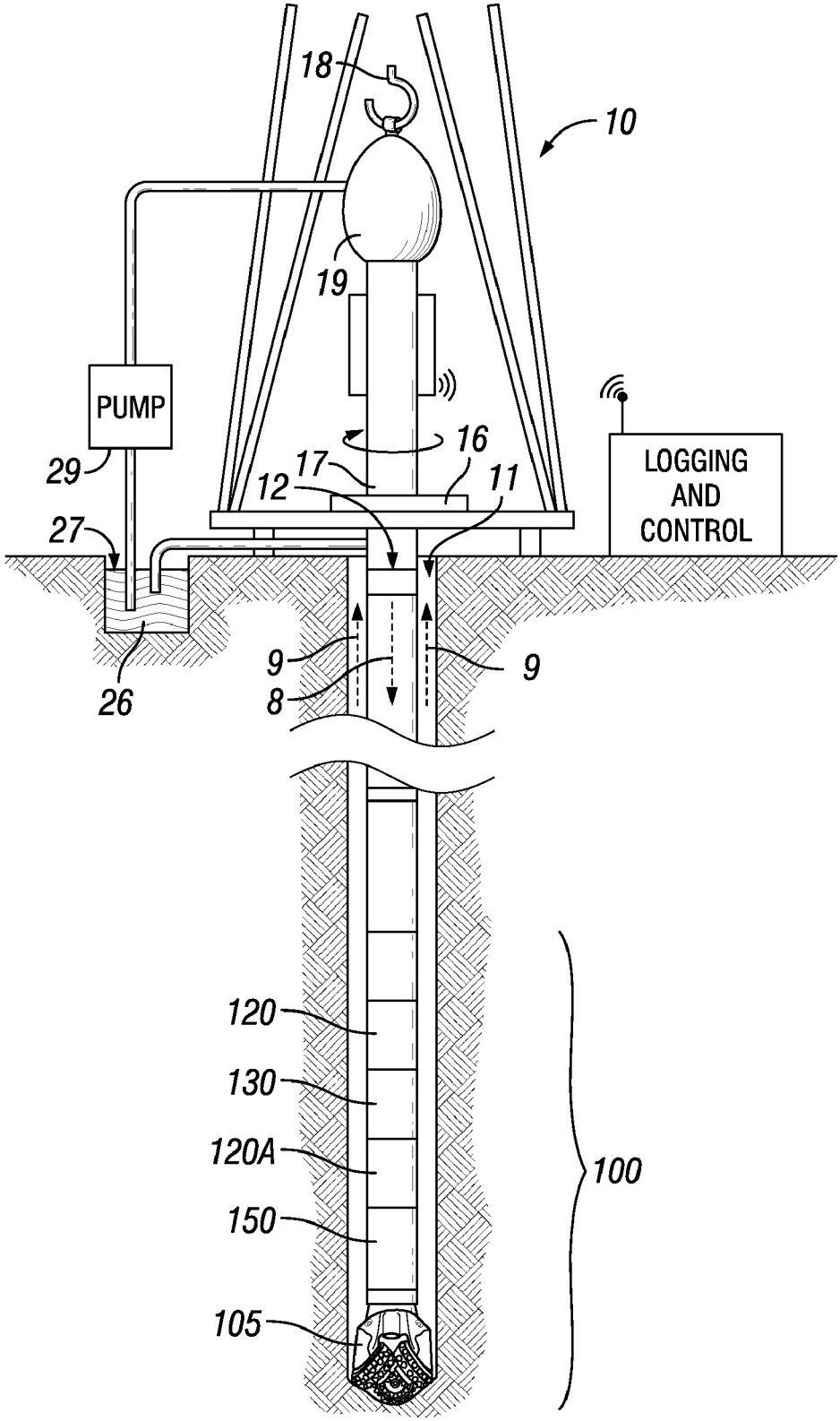
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Valve-Controlled Downhole Motor

Figure 2A:
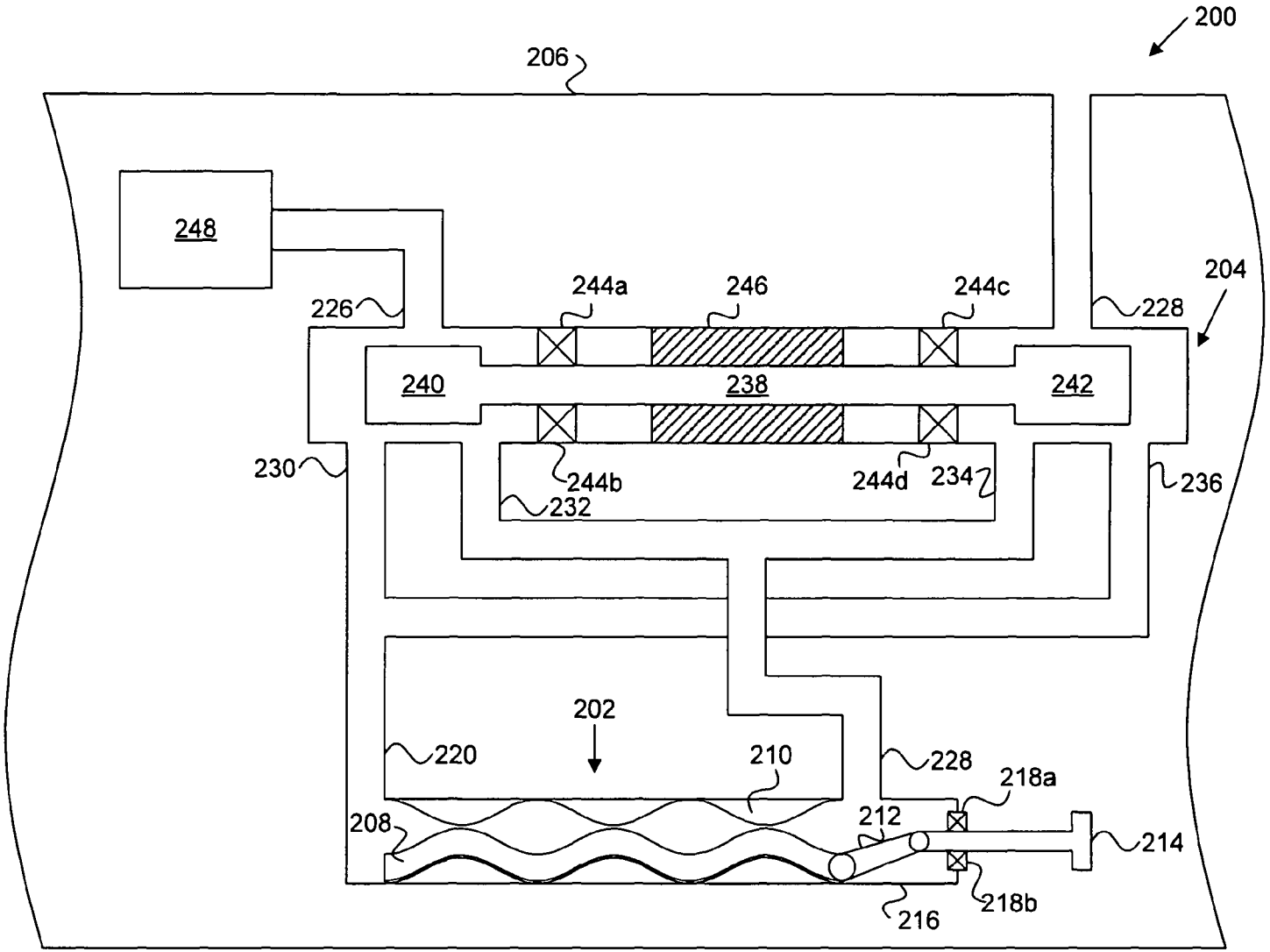
FIGS. 2A-2C illustrate the structure and operation of a valve-controlled downhole motor.

Referring to FIG. 2A, a system 200 is provided include downhole motor 202, controlled by a spool valve 204. Both the downhole motor 202 and the spool valve are located within a drill string 206. The components of FIG. 2A, like the components of all figures herein, are not necessarily drawn to scale.

Downhole motor 202 can be any of a number of now known or later developed downhole motors (also known as "mud motors"). Such devices include turbine motors, positive displacement motors, Moineau-type positive displacement motors, and the like. A Moineau-type positive displacement motor is depicted in FIG. 2A. Mud motors are described in a number of publications such as G. Robello Samuel, *Downhole Drilling Tools: Theory & Practice for Engineers & Students* 288-333 (2007); *Standard Handbook of Petroleum & Natural Gas Engineering* 4-276-4-299 (William C. Lyons & Gary J. Plisga eds. 2006); and 1 Yakov A. Gelfgat et al., *Advanced Drilling Solutions: Lessons from the FSU* 154-72 (2003).

Generally, a downhole motor consists of a rotor 208 and a stator 210. The rotor 208 is connected to a shaft 212 to transmit the power generated by rotation of the rotor 208. In the particular embodiment depicted in FIG. 2A, shaft 212 transmits the power a second shaft 214, which is supported at the end of downhole motor housing 216 by bearings 218*a* and 218*b*.

The rotational direction of rotor 208, and thereby shafts 212 and 214, is dictated by the direction and amount of flow through downhole motor 202. Downhole motor 202 includes a first conduit 220 and a second conduit 222 for receiving and/or exhausting fluid from the downhole motor 202. Conduits 220 and 222 are positioned on opposite ends of the rotor 208 and stator 210. Accordingly, the direction of fluid flow over the rotor 208 and stator 210 will vary depending on whether fluid is received from conduit 220 (and exhausted from conduit 222) or conduit 222 (and exhausted from conduit 222).

Spool valve 204 is configured to control the direction and quantity of fluid flow to downhole motor 202. Spool valve 204 includes a barrel 224 having an inlet port 226, an exhaust port 228, a first feed port 230, a second feed port 232, a first return port 234, and a second return port 236. Spool 238 resides within barrel 224. Spool 238 is selectively movable with the barrel to block or restrict flow from one or more ports 226, 228, 230, 232, 234, 236 with glands 240 and 242. (Glands 240 and 242 are depicted as smaller than the internal diameter of barrel 224 for the purposes of illustrating the function of spool valve 204. In many embodiments, the outer diameter of glands 240 and 242 will approximate the inner diameter of barrel 224 and/or may contain an elastomer, such as one or more O-rings, to block flow from one or more ports 226, 228, 230, 232, 234, 236. Spool 238 is supported by one or more bearings 244*a*, 244*b*, 244*c*, 244*d* and can be moved by actuator 246. Actuator 246 can be an electrical, mechanical, electromechanical, or pneumatic actuator as are known in the art. In some embodiments, the actuator is a servo. Spool valves are further described in T. Christopher Dickenson, *Valves, Piping & Pipelines Handbook* 138-45 (3d ed. 1999).

Inlet port 226 can be coupled with a filter 248 to prevent particles in the drilling fluid from clogging and/or damaging spool valve 204 and/or downhole motor 202. Exhaust port 228 can be coupled to the exterior of drill string 206.

Referring still to FIG. 2A, when spool valve is in a neutral position spool 238 is positioned such that (i) the flow to the first feed port substantially equals the flow to the second feed port and/or (ii) the flow to the first return port substantially equals the flow to the second return port. This can be accomplished in several ways. First, gland 240 can block or substantially block flow from inlet port 226. Second, gland 242 can block or substantially block flow to exhaust port 226. Third, glands 240 and 242 can (i) allow an equal or substantially equal flow from inlet port 226 to first feed port 230 and second feed port 232, and (ii) allow an equal or substantially equal flow from first return port 234 and second return port 236 to exhaust port 228. In either approach, the pressure on motor conduits 220 and 222 will be equal or substantially equal and rotor will not move.

Figure 2B:
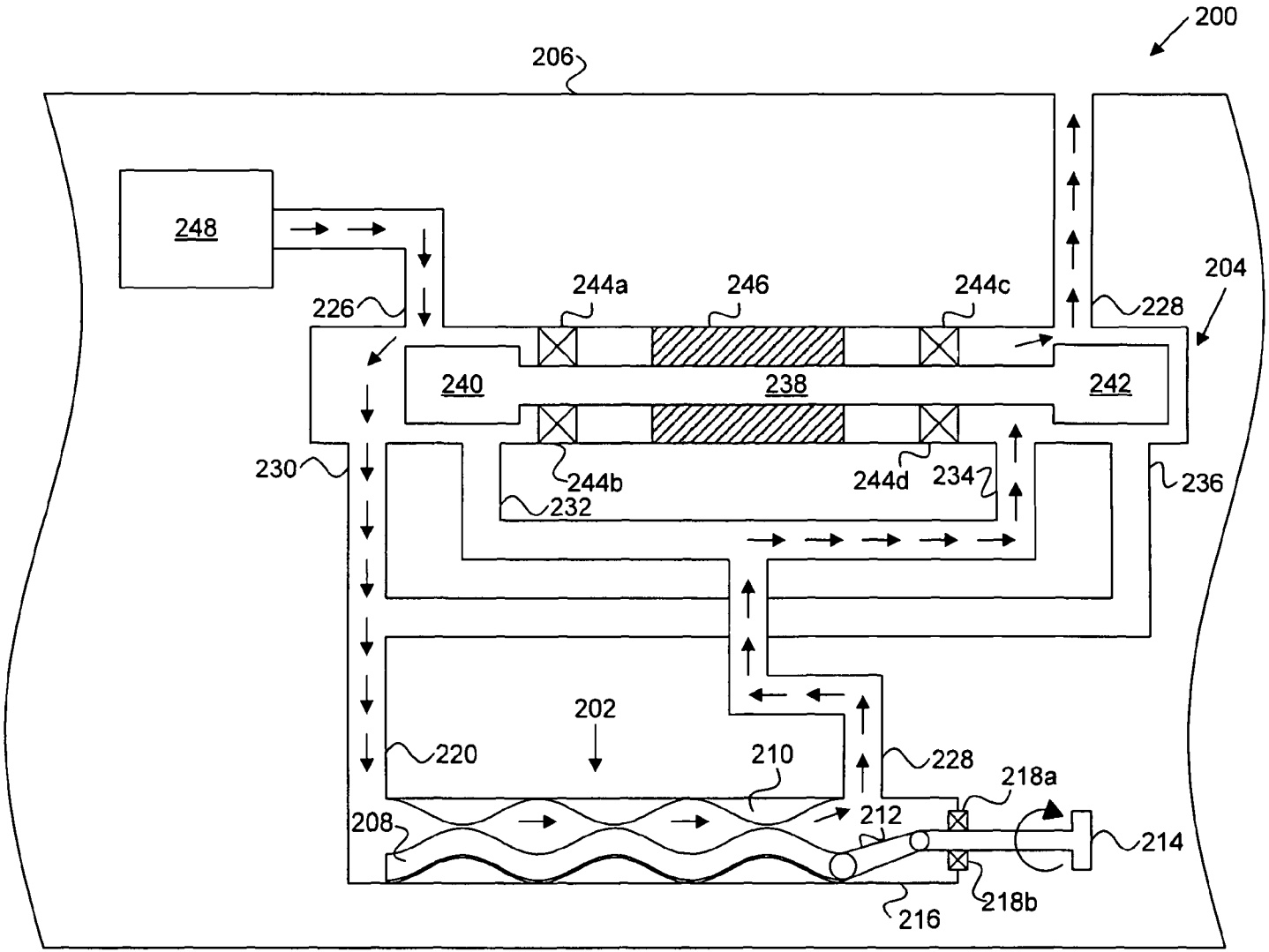

Referring now to FIG. 2B, spool valve 204 is actuated to a "forward" position. Increased flow is diverted from inlet port 226 to first feed port 230 and increased flow is permitted from first return port 234 to exhaust port 228. The fluid flows from first feed port 230 through the downhole motor 202 in a first direction turning shaft 214 in a "forward" direction before returning to spool valve via first return port 234.

Figure 2C:
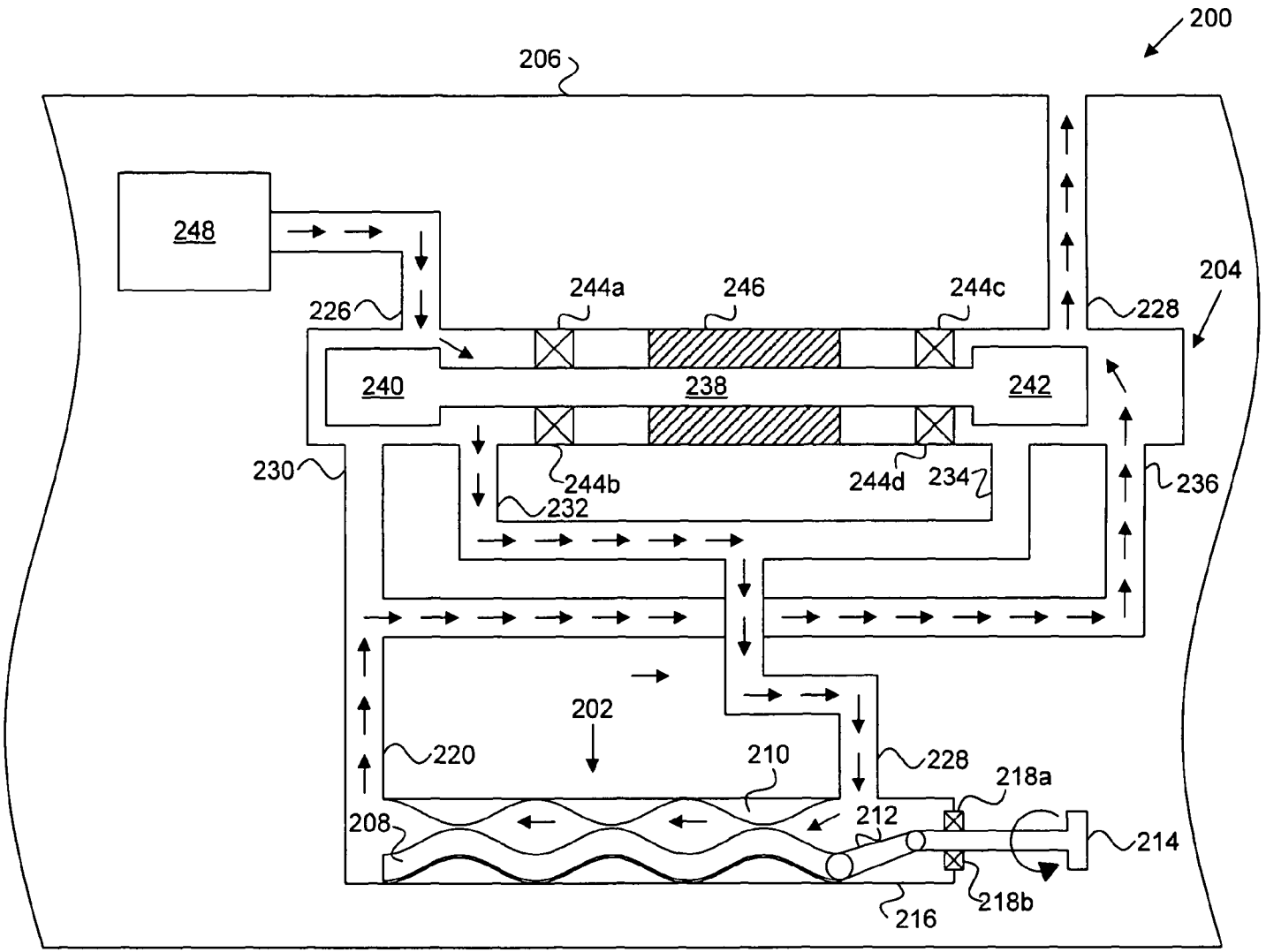

Referring now to FIG. 2C, spool valve 204 is actuated to a "reverse" position. Increased flow is diverted from inlet port 226 to second feed port 232 and increased flow is permitted from second return port 236 to exhaust port 228. The fluid flows from second feed port 232 through the downhole motor 202 in a second direction turning shaft 214 in a "reverse" direction before returning to spool valve via second return port 236.

Spool valve 204 can be actuated to control speed in either direction. This can be accomplished by partially impeding the flow to and from corresponding feed and return ports. The spool valve 204 and the downhole motor 202 can be configured so that there is a linear relationship between a position of the spool and a rotational velocity of the rotor. Such a relationship can be formed, for example, by configuring ports 226, 228, 230, 232, 234, 236 so that the increase in exposed port area (and therefore flow) increases linearly as the spool 238 moves.

Figure 3:
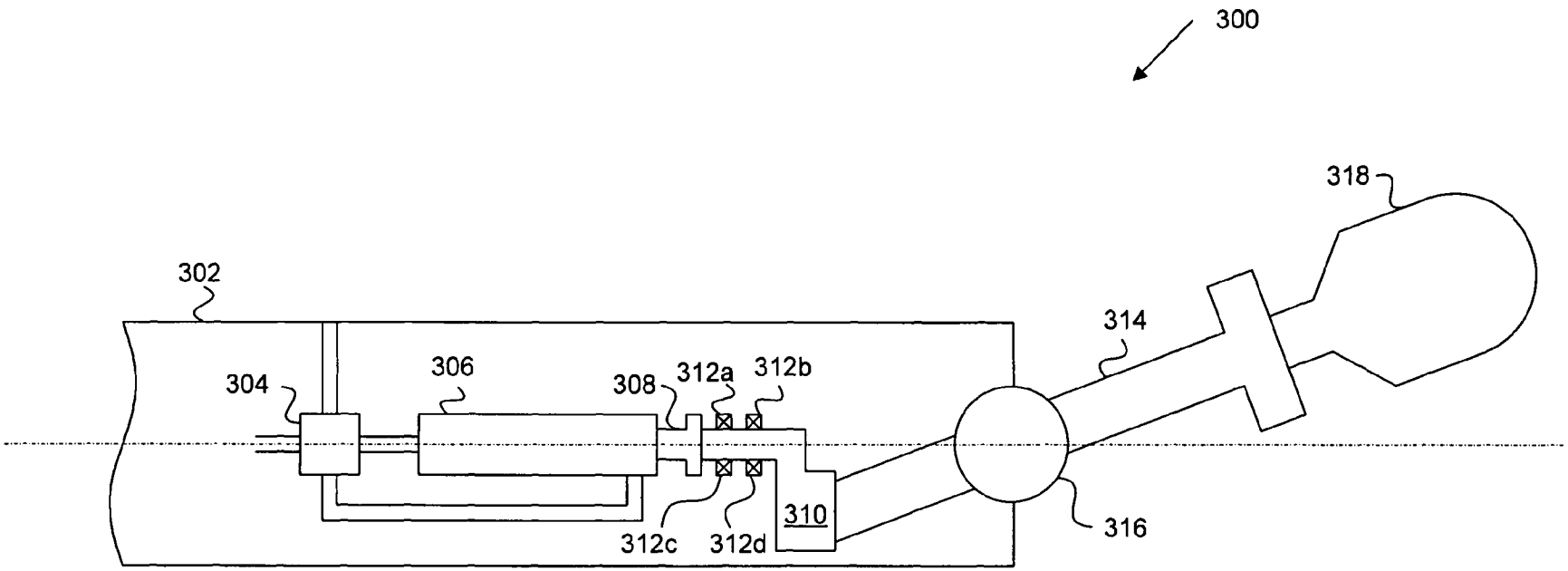
FIG. 3 illustrates a configuration of a valve-controlled downhole motor to point the bit.

The valve-controlled downhole motor can be used to steer a drill bit in order to implement "point the bit" steering. Referring now to FIG. 3, a system 300 is provided including a drill string 302, a spool valve 304, and a downhole motor 306. The downhole motor shaft 308 is coupled to an offset shaft 310 supported by bearings 312*a*, 312*b*, 312*c*, 312*d*. The offset shaft rotates pivot 314, which can be supported by a ball joint 316 or the like. A drill bit 318 is connected to pivot 314.

When coupled with a rotation sensor, a drill string collar speed sensor, and/or other position sensing equipment, the spool valve 304 can be selectively actuated to maintain to the position of drill bit 318 as the drill string 302 rotates, thereby drilling a curved borehole. A processor can also be configured to calculate the relative rotational speed of shaft 310 to drill string 302.

Casing Exiting

For a variety of reasons, it is often necessary or desirable to drill a second borehole that branches off of a first borehole. This technique is referred to as a casing exiting or side tracking. This can be necessary, for example, when a drill string breaks and it is either impossible or not economical to recover the broken drill string from the bottom of the first borehole.

Figure 4:
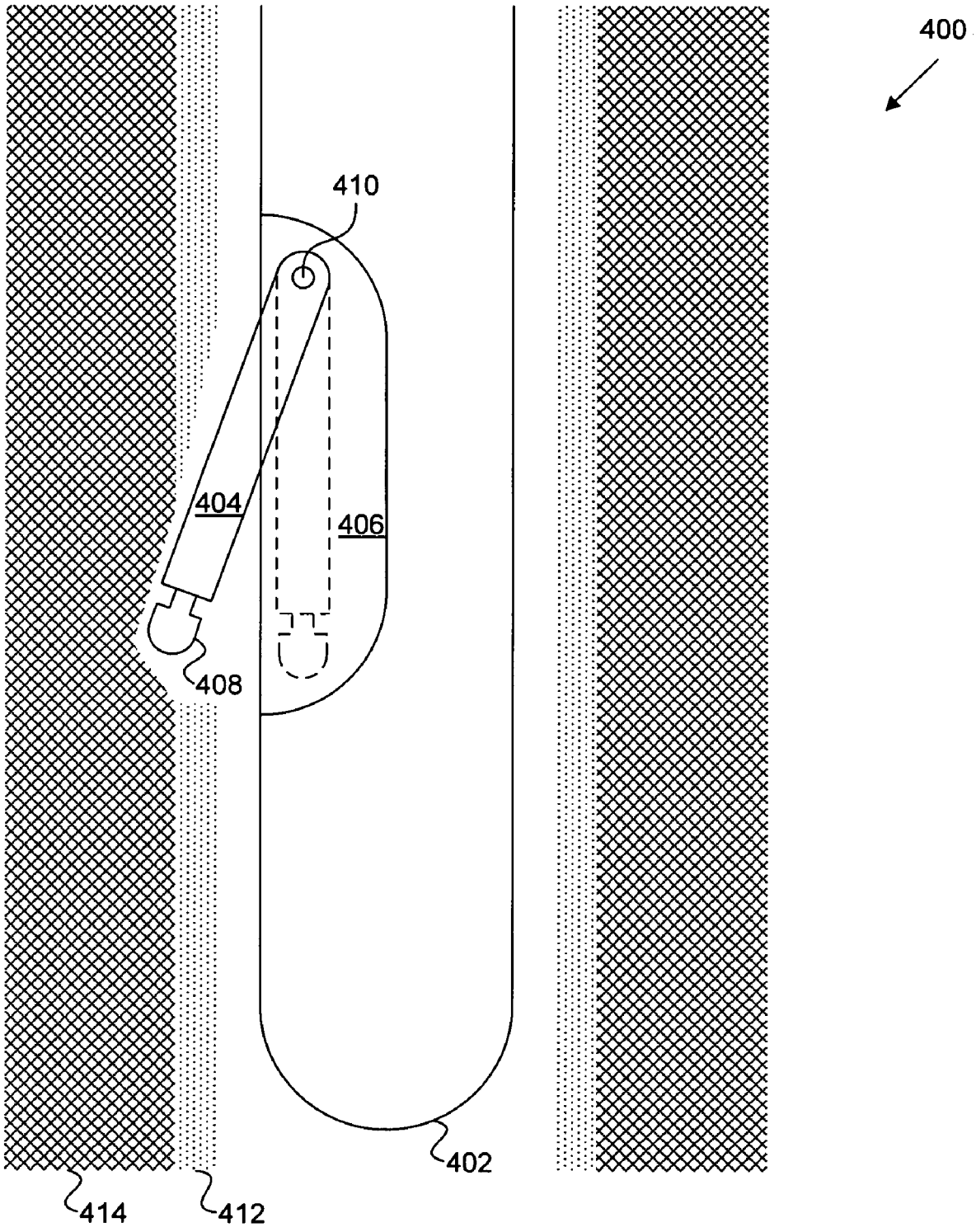
FIG. 4 illustrates a device for side tracking.

Referring to FIG. 4, a system 400 is provided for a side tracking. A drill string 402 is provided, which houses an arm 404 within a groove 406, and in some embodiments, substantially parallel to a central axis of the drill string 402. The arm 404 includes a drill bit 408, which can be operated by a valve-controlled downhole motor as described herein. The arm 404 rotates about a pivot 410. The rotation of arm 404 can also be controlled by the same or different downhole motor. As shown in FIG. 4, the drill bit 408 is capable of drilling though a rock formation 412 and/or a concrete casing 414.

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. A valve-controlled downhole motor comprising:
a downhole motor having:
a sealed chamber having a first port and a second port;
a stator received within the sealed chamber; and
a rotor received within the stator; and
a spool valve including:
a barrel having:
an inlet port;
an exhaust port;
a first feed port;
a second feed port;
a first return port; and
a second return port;
wherein the inlet port is located in proximity to the first feed port and second port; and
wherein the exhaust port is located in proximity to the first return port and the second return port; and
a spool received within the barrel, the spool having:
a first gland; and
a second gland,
wherein the spool valve is configured such that there is a linear relationship between a position of the spool and a rotational velocity of the rotor.

2. The valve-controlled downhole motor of claim 1, wherein the spool valve is configured for actuation to a locking position that substantially halts movement of the downhole motor.

3. The valve-controlled downhole motor of claim 2, wherein the first gland substantially inhibits flow from the inlet port, and the second gland substantially inhibits flow to the exhaust port.

4. The valve-controlled downhole motor of claim 2, wherein the first gland completely inhibits flow from the inlet port, and the second gland completely inhibits flow to the exhaust port.

5. The valve-controlled downhole motor of claim 2, wherein the first gland and the second gland allow a substantially equal flow of fluid from the inlet port to each of the first feed port the second feed port and from the each of first return port and the second return port to the exhaust port.

6. The valve-controlled downhole motor of claim 1, wherein the spool valve is configured for actuation to a forward position that propels the rotor of the downhole motor in a first direction.

7. The valve-controlled downhole motor of claim 6, wherein the first gland allows unimpeded flow from the inlet port to the first feed port, and the second gland allows unimpeded flow from the first return port to the exhaust port.

8. The valve-controlled downhole motor of claim 6, wherein the first gland allows partially impeded flow from the inlet port to the first feed port, and the second gland allows partially impeded flow from the first return port to the exhaust port.

9. The valve-controlled downhole motor of claim 1, wherein the spool valve is configured for actuation to a reverse position that propels the rotor of the downhole motor in a second direction, the second direction being opposite from the first direction.

10. The valve-controlled downhole motor of claim 9, wherein the first gland allows unimpeded flow from the inlet port to the second feed port, and the second gland allows unimpeded flow from the second return port to the exhaust port.

11. The valve-controlled downhole motor of claim 9, wherein the first gland allows partially impeded flow from the inlet port to the second feed port, and the second gland allows partially impeded flow from the second return port to the exhaust port.

12. The valve-controlled downhole motor of claim 1, wherein the spool valve is mechanically actuated.

13. The valve-controlled downhole motor of claim 1, wherein the spool valve is electrically actuated.

14. The valve-controlled downhole motor of claim 1, wherein the spool valve is pneumatically actuated.

15. The valve-controlled downhole motor of claim 1, wherein the downhole motor is a turbine motor.

16. The valve-controlled downhole motor of claim 1, wherein the downhole motor is a positive displacement motor.

17. The valve-controlled downhole motor of claim 16, wherein the downhole motor is Moineau-type positive displacement motor.

18. The valve-controlled downhole motor of claim 1, wherein the valve-controlled downhole motor is received within a drill string collar.

19. The valve-controlled downhole motor of claim 18, further comprising:

a collar speed sensor for measuring the rotational speed of the drill string collar.

20. The valve-controlled downhole motor of claim 18, wherein the valve-controlled downhole motor is configured to point a bit coupled with the drill string collar.

21. The valve-controlled downhole motor of claim 20, wherein the valve-controlled downhole motor is configured for side tracking.

22. The valve-controlled downhole motor of claim 1, further comprising:

a shaft connected to the rotor.

23. The valve-controlled downhole motor of claim 22, wherein the shaft is an offset shaft.

24. The valve-controlled downhole motor of claim 23, further comprising:

a shaft speed sensor for measuring the rotational speed of the shaft.

25. The valve-controlled downhole motor of claim 24, further comprising:

a processor configured to calculate the relative speed of the shaft with respect to the collar.

26. The valve-controlled downhole motor of claim 1, wherein the spool valve is a bistable actuator.

* * * * *